US006174045B1

(12) United States Patent
Kerr et al.

(10) Patent No.: US 6,174,045 B1
(45) Date of Patent: Jan. 16, 2001

(54) METHOD AND APPARATUS FOR PRINTING COLOR IMAGES USING AN INKJET PRINTHEAD AND A LASER THERMAL PRINTHEAD

(75) Inventors: Roger S. Kerr, Brockport; Seung H. Baek, Pittsford; William L. Demarco, Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/430,320

(22) Filed: Oct. 29, 1999

(51) Int. Cl.[7] ..... B41J 2/21; B41J 3/00; B41J 11/00

(52) U.S. Cl. ..... 347/43; 2/176

(58) Field of Search ..... 347/2, 43, 103, 347/104, 101, 176, 187, 213; 346/45, 125, 132

(56) References Cited

U.S. PATENT DOCUMENTS

| | | | |
|---|---|---|---|
| 4,595,303 | 6/1986 | Kuzuya et al. | 400/82 |
| 5,081,596 | 1/1992 | Vincent et al. | 358/1.4 |
| 5,167,456 | 12/1992 | Murakoshi et al. | 400/120.02 |
| 5,184,900 | 2/1993 | Eisner et al. | 400/82 |
| 5,268,708 | 12/1993 | Harshbarger et al. | 346/134 |
| 5,428,375 | 6/1995 | Simon et al. | 347/12 |
| 5,488,397 | 1/1996 | Nguyen et al. | 347/40 |
| 5,611,629 | 3/1997 | Paranjpe | 400/82 |
| 5,677,719 | 10/1997 | Granzow | 347/103 |
| 5,764,254 | 6/1998 | Nicoloff, Jr. et al. | 347/43 |
| 5,785,435 | 7/1998 | Koo | 400/120.02 |
| 5,889,534 | 3/1999 | Johnson et al. | 347/19 |

FOREIGN PATENT DOCUMENTS 6-64246 * 3/1994 (JP) .

* cited by examiner

*Primary Examiner*—Thinh Nguyen
(74) *Attorney, Agent, or Firm*—Nelson Adrian Blish

(57) ABSTRACT

A color printer (10) for printing a color images comprising a vacuum imaging drum (300) for supporting a first receiver and a dye donor material (26) in registration with the first receiver. A motor rotates the vacuum imaging drum (300). An optical printhead directs energy on the dye donor material (26), which transfers colorant from the dye donor material (26) to the first receiver forming color images as the optical printhead is transported parallel to a surface of the vacuum imaging drum (300). After the dye donor material (26) and the first receiver have been removed from the vacuum imaging drum (300), an inkjet printhead (602) applies ink to a second receiver mounted on the vacuum imaging drum (300) as the inkjet printhead (602) is transported parallel to the surface of the vacuum imaging drum (300).

24 Claims, 5 Drawing Sheets

METHOD AND APPARATUS FOR PRINTING COLOR IMAGES USING AN INKJET PRINTHEAD AND A LASER THERMAL PRINTHEAD

FIELD OF THE INVENTION

This invention relates to printers in general and more particularly to a color printer using an inkjet printhead and a laser thermal printhead to print color images.

BACKGROUND OF THE INVENTION

A number of imaging technologies are used in the high-quality color printing market. Among the leading imaging technologies used for pre-press color proofing are laser thermal printers, disclosed in U.S. Pat. No. 5,268,708, and inkjet color printers.

Each of these imaging technologies has inherent advantages and disadvantages. Laser thermal printing provides high-quality images that are often used as final proofs for emulating the output of a four-color offset printing system. Laser thermal printing uses laser energy to transfer colorant from a dye donor material to a receiver media. Because the laser printhead can focus a laser beam on an area of donor that is only a few microns in diameter, laser thermal printing is ideally suited for halftone dot reproduction on a color proof, emulating an offset printer's halftone dots by "pixelization," printing onto a receiver medium a grouping of tiny, adjacent microdots that taken together give the appearance of a halftone dot. Because the exposure energy used for printing these microdots can be varied over a range of values, laser thermal imaging allows a printer to emulate an offset printer's ink density.

A limitation of laser thermal printing is that media costs are high due to the use of separate donors in addition to the receiver media. Dye donor material is typically provided in sheet or roll form with the colorant embedded on a film base and several different color sheets are used to print one image. Another problem with laser thermal printing is use of specialty colors, which are used for corporate identity logos and packaging. Specialty colors are separately formulated inks. Rather than the "subtractive" process, which uses Cyan, Magenta, Yellow, and black, or CMYK inks, specialty colors emulate colors in halftone color offset printing. Because of the number of specialty inks required in commercial printing, it would be impracticable to make rolls of dye donor material for all the specialty colors in use.

Inkjet printers are also used for color proofing. Inkjet printing operates by applying ink in tiny discrete droplets to a receiver. Inkjet devices may operate using A continuous flow of ink where droplets are continuously produced during printing and unneeded droplets are deflected into a waste collector, or "drop-on-demand" printing wherein droplets are emitted by the printhead only when needed. Inkjet imaging technology can be used for generating color proofs by emulating halftone dots, or by printing continuous tone color areas.

Inkjet imaging, however, does not offer the advantages of variable density afforded by varying exposure energy with laser thermal printing. However, inkjet has other advantages, including generally lower media costs. A significant advantage of inkjet technology is that specialty color inks can be formulated at lower expense than is possible for laser thermal technology. A comparison of laser thermal and inkjet printing shows that the strengths of one technology often complement the weaknesses of the other.

Color proofing saves customers time and money when preparing high-quality printed materials. The more closely a color proof emulates the end-result of a printing press, the more likely a print job will run smoothly, minimize waste, and provide customers with a pleasing product. The final proof is typically treated as a contractual instrument, to be carefully examined and approved by the customer before the costly process of printing system setup and operation is initiated.

For high-quality print jobs, color proofing typically proceeds in stages. Early in the pre-press process, a "draft-quality" color proof may be sufficient for establishing final layout arrangement and overall appearance. As pre-press work progresses, successively better, intermediate-quality proofs are often desirable for showing the effectiveness of a color image and for refining its appearance. Then, as a job nears completion and is ready for final sign-off by the customer, a high-quality proof is needed, to show, as closely as possible, how the job will print. To match the workflow requirements of this process, a pre-press operator may prepare an early "draft-quality" proof inexpensively, using a low-cost inkjet printer. Then, for the final proof, the pre-press operator may prepare a final quality proof on a high-quality laser thermal printer. It would be advantages if a single printer could both provide draft and intermediate quality color proofs as well as a final color proof.

It can be appreciated by those familiar with digital imaging that, for both laser thermal and inkjet printers, the mechanical subsystem needed for handling paper or other receiver media must be able to feed the media correctly from a source roll or sheet feeder to a writing mechanism, and to support the media securely during printing for accurate resolution. The method predominantly employed for large-format printers is to mount the receiver on an imaging drum and use vacuum to attach the media to the imaging drum for printing. Thus, for acquiring and supporting the receiver for printing, the media handling subsystem for a laser thermal printer must perform many of the same tasks as the media handling subsystem for an inkjet printer.

It will also be appreciated by those familiar with digital imaging that the mechanical subsystem needed for printing a proof using an inkjet printhead must also perform the same tasks as the mechanical subsystem for printing a proof using laser thermal technology. For both, a printhead is passed over the surface of a receiver and the image is applied, either directly to the receiver or to an intermediate. The imaging drum rotates as the printhead moves in a line along the imaging drum parallel to the drum axis, applying the image to the receiver in a helical swath. It would be more efficient to use the same precision printhead positioning mechanism to perform both laser thermal imaging and inkjet imaging.

It is known that the use of multiple printheads in a single printer can provide certain advantages. Using multiple printheads of the same type, using the same printing technology, has been a strategy employed to boost printer efficiency. U.S. Pat. No. 5,677,719 (Granzow) teaches use of multiple inkjet printheads, each printing on a specific area of a receiver to increase printer speed and facilitate ink drying. U.S. Pat. No. 5,184,900 (Eisner et al) discloses a high-volume, high-speed printer having multiple dot matrix printheads to allow concurrent printing of an address and a bar code on envelopes for mailing. U.S. Pat. No. 5,488,397 (Nguyen et al.) discloses an arrangement of multiple inkjet printheads to effectively provide a wider print swath for improved printer throughput.

In addition to improving efficiency, multiple printheads have also been employed to improve image quality. As an example, multiple identical inkjet printheads are employed for pixel interleaving, effectively increasing the resolution available from a printer, as disclosed in U.S. Pat. No. 5,889,534 (Johnson et al.) and in U.S. Pat. No. 5,428,375 (Simon et al.). U.S. Pat. No. 5,764,254 (Nicoloff, Jr. et al.) discloses a printer having multiple inkjet printheads with different resolutions, wherein a black printhead is at a higher resolution than a color printheads, to provide black text characters at a higher resolution than is available for color inks.

There are other image quality benefits when a printer uses two or more printheads of different types, wherein each printhead has specific advantages for its intended use. For example, U.S. Pat. No. 4,595,303 (Kuzuya et al.) discloses a monochrome printer with a first type-printing printhead for producing crisp, clear text characters and a second dot matrix printhead for printing raster images or providing alternate font characters on the same output sheet. U.S. Pat. No. 5,167,456 (Murakoshi et al.) discloses a color thermal printer having a first text character printer using a black ink film and a second thermal wax transfer printer for printing Cyan, Magenta, and Yellow colors onto the same output sheet. U.S. Pat. No. 5,081,596 (Vincent et al.) discloses a text and color image printing system in which a first inkjet printhead applies color and a second laser printer prints text onto the same output sheet. U.S. Pat. No. 5,785,435 (Koo) discloses a text and color image printing system in which a first dye sublimation printhead prints a color image and a second inkjet printer or laser printer prints text on the same output sheet. U.S. Pat. No. 5,611,629 (Paranjpe) discloses a printer that employs a first dye-diffusion thermal printhead for printing Cyan, Magenta, and Yellow colors and a second thermal ink transfer printhead for printing black on the same output sheet.

While printers having multiple printheads are known, no printers combine the advantages provided by a laser thermal printhead and an inkjet printhead. The printers disclosed in the patents noted above use multiple printheads to print to the same receiver. None of these printers provide the option to print the same color image using either one printhead or the other. There is no option to print on a first receiver using the first printhead, and on a second receiver using a second printhead, while also allowing the option to print on a third receiver using both first and second printheads. None of the printers disclosed above employs the same printhead translation subsystem for both first and second printheads. The patents listed above require separate printhead stations and, in some cases, even separate receiver handling apparatus for applying the image to the receiver.

It would be advantageous to provide a printer that combines the advantages of both a laser thermal printhead and a inkjet printhead housed within a single apparatus.

SUMMARY OF THE INVENTION

It is an object of the present invention to provide a color printer that provides the benefits of both laser thermal printing and inkjet printing.

According to one aspect of the present invention a color printer for printing color images comprises a vacuum imaging drum for supporting a first receiver and a dye donor material in registration with the first receiver. A motor rotates the vacuum imaging drum. An optical printhead directs energy on the dye donor material, which transfers colorant from the dye donor material to the first receiver, forming a first color image as the optical printhead is transported parallel to a surface of the vacuum imaging drum. After the dye donor material and the first receiver have been removed from the vacuum imaging drum, an inkjet printhead applies ink to a second receiver, mounted on the vacuum imaging drum, to create a second color image as the inkjet printhead is transported parallel to the surface of the vacuum imaging drum. In the preferred embodiment, the optical printhead is a laser printhead.

In a preferred embodiment, both an optical printhead for laser thermal printing and an inkjet printhead are attached to the same movable platform which is moved along the surface of the imaging drum. The receiver is positioned on the imaging drum, allowing an image to be written using either laser thermal colorant, inkjet colorant, or both laser thermal and inkjet colorants. The present invention also provides an output color print having images created using both laser thermal and inkjet printing.

An advantage of the present invention is that the use of a single printhead translation and positioning subsystem for use with both laser thermal and inkjet printheads leverages common design solutions and saves cost.

It is also an advantage of the present invention that it provides a single apparatus which allows an operator to produce a color print using either inkjet or laser thermal printing technologies, to suit the requirements of a pre-press proofing job.

It is a further advantage of the present invention that it allows an operator to produce a color print using both inkjet and laser thermal printing technologies on the same machine.

The invention and its objects and advantages will become more apparent in the detailed description of the preferred embodiment presented below.

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

For the description that follows, the term "receiver" describes medium onto which colorant is applied. By way of example only, and not by way of limitation, receiver material can be any of the following: Paper, whether provided in sheet or roll form. A wide variety of paper stocks can be used for digital prepress proofing. The receiver may be provided in sheet or roll form. As one example, a film-based receiver is used. The image is transferred from the receiver onto paper by applying heat and pressure using a separate apparatus.

The term "colorant" applies to inks, dyes, or other colored material that is applied to the receiver in the printing operation.

Figure 1:
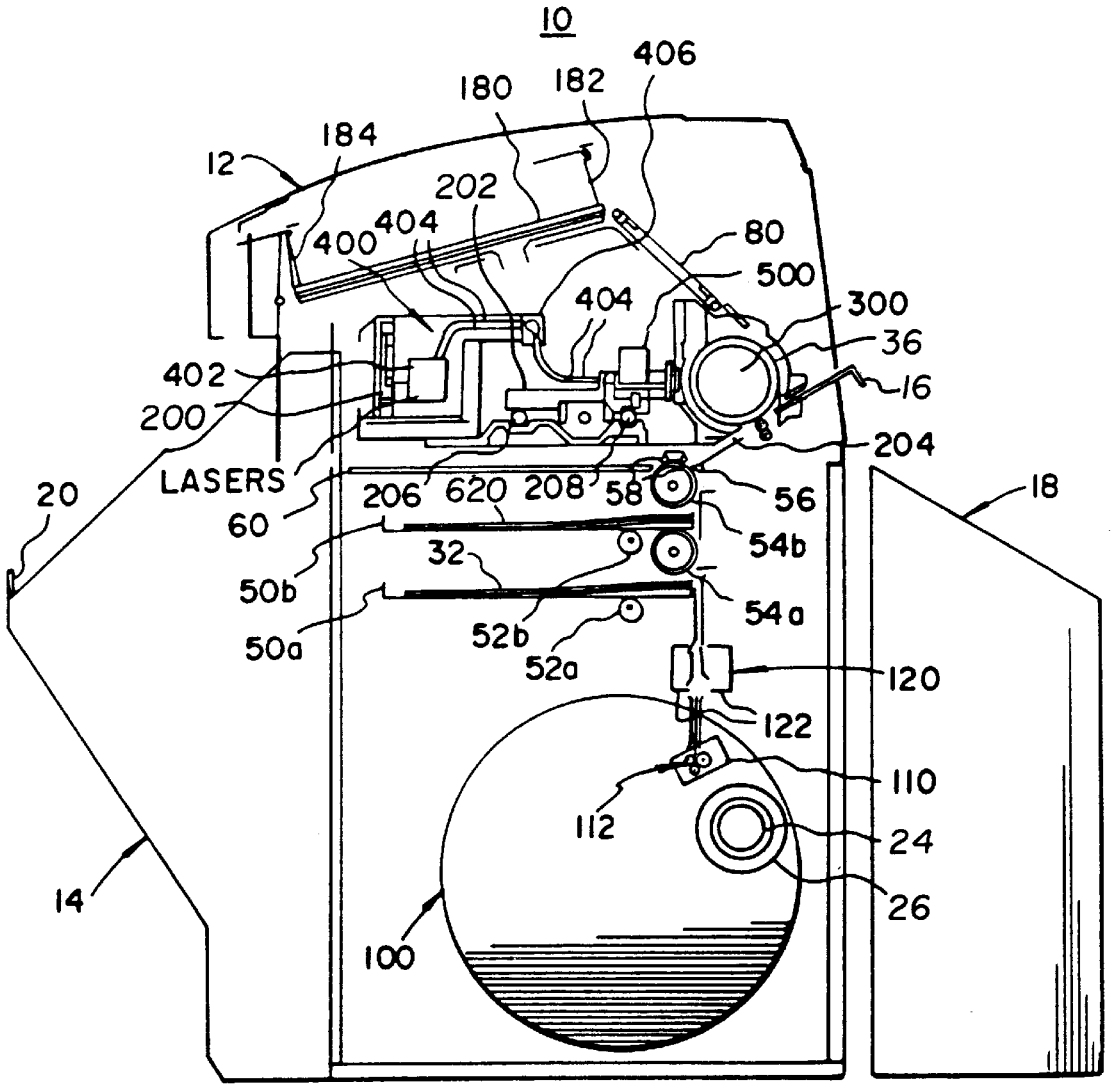
FIG. 1 (PRIOR ART)
FIG. 1 shows a view in vertical section of a prior art laser thermal printer.

FIG. 1 shows a cross-sectional view of a prior art color printer 10 employing laser thermal imaging technology. This type of system is more completely described in commonly assigned U.S. Pat. No. 5,268,708. However, for purposes of description of the present invention, salient components and operational aspects of this system, particularly with respect to media handling, are described below.

Color printer 10 according to the present invention has a housing 12 which provides a protective cover. A movable, hinged door 14 is attached to the front portion of housing 12 permitting access to a lower sheet material tray 50*a* and an upper sheet material tray 50*b*. Material trays 50*a* and 50*b* are positioned in the interior portion of housing 12 for supporting thermal print media 32. Lowe sheet material tray 50*a* dispenses thermal print media 32 to create an intended image thereon. The alternate upper sheet material tray 50*b* either holds an alternative type of media, additional thermal print media 32, or functions as a back-up sheet material tray. More specifically, lower sheet material tray 50*a* includes a lower media lift cam 52*a* for lifting lower sheet material tray 50*a* and ultimately thermal print media 32, upwardly toward a rotatable, lower media roller 54*a* and also toward a second rotatable, upper media roller 54*b*. When both rollers 54*a* and 54*b* are rotated, rollers 54*a* and 54*b* enable thermal print media 32 in lower sheet material tray 50*a* to be pulled upwardly towards a movable media guide 56. Upper sheet material tray 50*b* includes an upper media lift cam 52*b* for lifting upper sheet material tray 50*b* and, ultimately, its sheet media towards upper media roller 54*b* which directs it towards media guide 56.

Media guide 56 directs thermal print media 32 under a pair of media guide rollers 58. Media guide rollers 58 engage thermal print media 32 for assisting upper media roller 54*b*, so as to direct thermal print media 32 onto a media staging tray 60. An end of media guide 56 is rotated downwardly, as illustrated in the position shown, and the direction of rotation of upper media roller 54*b* is reversed. Reversing direction of rotation of upper media roller 54*b* moves thermal print media 32, which is resting on media staging tray 60, to a position under the pair of media guide rollers 58, upwardly through an entrance passageway 204 and around a rotatable vacuum imaging drum 300. At this point, thermal print media 32 rest on vacuum imaging drum 300.

A generally cylindrical dye media spool 24 of dye donor material 26 is connected to a media carousel 100 in a lower portion of housing 12. Preferably, four media spools 24 are used, but only one is shown for clarity. Each of the four media spools 24 includes a dye donor material 26 of a different color, such as Cyan, Magenta, Yellow, and BlacK (CMYK). Also, it may be understood from the teachings herein that media spool 24 may have a receiver material wrapped thereabout, rather than dye donor material 26, for use in a printer having the appropriate structure to accept such a spool wrapped with receiver. Dye donor material 26 is ultimately cut into donor sheet materials 36 and passed to vacuum imaging drum 300 for forming the donor medium from which colorant imbedded therein is passed to the thermal print media 32.

A media drive mechanism 110 is attached to each media spool 24 and includes three media drive rollers 112 through which dye donor material 26 is metered upwardly into a media knife assembly 120. After the dye donor material 26 reaches a predetermined position, media drive rollers 112 cease driving dye donor material 26. At this point, two media knife blades 122 positioned at a bottom portion of media knife assembly 120 cut dye donor material 26 into donor sheet materials 36. Lower media roller 54*a* and upper media roller 54*b* along with media guide 56 then pass donor sheet material 36 onto media staging tray 60 and ultimately to vacuum imaging drum 300. Donor sheet materials 36 are passed in registration with the thermal print media 32. At this point, donor sheet material 36 now rests atop thermal print media 32. This process of passing donor sheet material 36 onto vacuum imaging drum 300 is substantially the same process as described hereinabove for passing thermal print media 32 onto vacuum imaging drum 300.

Figure 2:
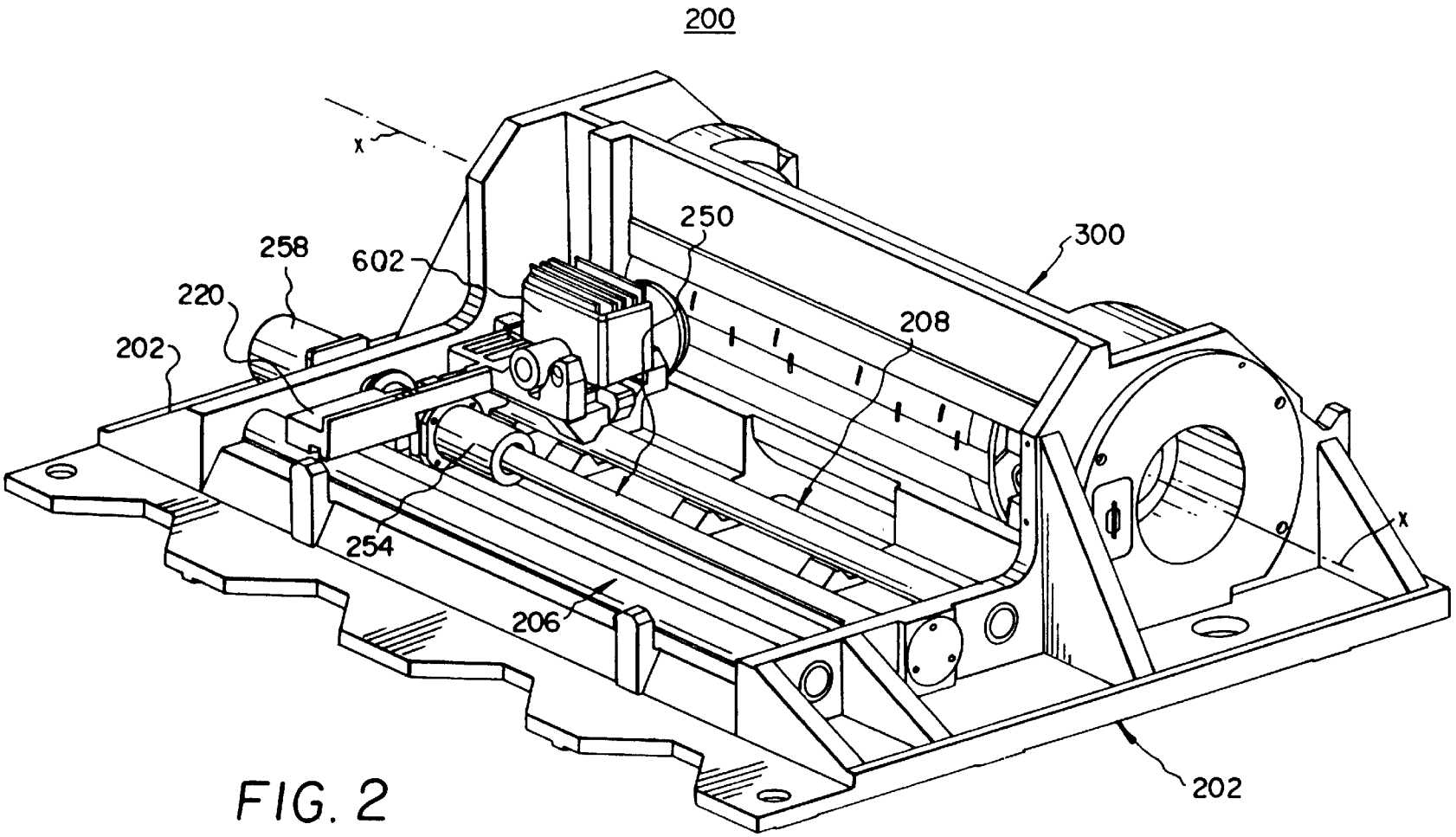
FIG. 2 (PRIOR ART)
FIG. 2 shows a perspective view of a printhead translation subsystem for a prior art laser thermal printer.

Referring to FIGS. 1 and 2, a laser assembly, generally referred to as 400 includes a quantity of laser diodes 402. Laser diodes 402 are connected by means of fiber optic cables 404 to a distribution block 406 and ultimately to an optical printhead 500. In the preferred embodiment optical printhead 500 is a laser printhead. Optical printhead 500 directs thermal energy received from laser diodes 402 and causes donor sheet material 36 to pass the desired color to thermal print media 32. Optical printhead 500 is movable with respect to vacuum imaging drum 300 and is arranged to direct a beam of light to donor sheet material 36. For each laser diode 402, the beam of light from optical printhead 500 is individually modulated by modulated electronic signals, which signals are representative of the shape and color of the original image. In this manner, donor sheet material 36 is heated to cause volatilization only in those areas of thermal print media 32 necessary to reconstruct the shape and color of the original image.

Optical printhead 500 is attached to a lead screw 250 by means of a lead screw drive nut 254 and a drive coupling (not shown) for axial movement along the longitudinal axis of vacuum imaging drum 300 for transferring the data to create the intended image onto thermal print media 32.

For writing, vacuum imaging drum 300 rotates at a constant velocity. Travel of optical printhead 500 begins at one end of thermal print media 32 and traverses the entire length of thermal print media 32 for completing the colorant transfer process for donor sheet material 36 resting on thermal print media 32. After optical printhead 500 has completed the transfer process for donor sheet material 36 resting on thermal print media 32, donor sheet material 36 is then removed from vacuum imaging drum 300 and transferred out of housing 12 by means of an ejection chute 16. Donor sheet material 36 eventually comes to rest in a waste bin 18 for removal by the operator of color printer 10. The above described process is then repeated for the other three media spools 24 of dye donor materials 26.

After colorants from the four media spools 24 have been transferred and donor sheet materials 36 have been removed from vacuum imaging drum 300, thermal print media 32 is removed from vacuum imaging drum 300 and transported by means of a transport mechanism 80 to a color binding assembly 180. A media entrance door 182 of color binding assembly 180 is opened for permitting thermal print media 32 to enter color binding assembly 180, and shuts once thermal print media 32 comes to rest in color binding assembly 180. Color binding assembly 180 processes thermal print media 32 for further binding the transferred colors on thermal print media 32. After the color binding process has been completed, media exit door 184 is opened and thermal print media 32 with the intended image thereon passes out of binding assembly 180 and housing 12 and comes to rest against a media stop 20.

Referring to FIG. 2, a perspective view of a lathe bed scanning subsystem 200, includes vacuum imaging drum 300, optical printhead 500 and lead screw 250 assembled in a lathe bed scanning frame 202. Vacuum imaging drum 300 is mounted for rotation about an axis X in lathe bed scanning frame 202.

Optical printhead 500 is mounted on a movable translation stage member 220 which, in turn, is supported for low friction slidable movement on a rear translation bearing rod 206 and a front translation bearing rod 208. Translation bearing rods 206 and 208 are sufficiently rigid so as not to sag or distort and are arranged to be as parallel as possible with the axis X of the vacuum imaging drum 300 with the axis of the optical printhead 500 at a normal to axis X of the vacuum imaging drum 300. Front translation bearing rod 208 locates a translation stage member 220 in the vertical and the horizontal directions with respect to axis X of vacuum imaging drum 300. Rear translation bearing rod 206 locates translation stage member 220 only with respect to rotation of translation stage member 220 about front translation bearing rod 208 so that there is no over-constraint condition of translation stage member 220 which might cause it to bind, chatter, or otherwise impart undesirable vibration or jitters to optical printhead 500 during the generation of an intended image.

Optical printhead 500 travels in a path along vacuum imaging drum 300, moved by lead screw drive nut 254 while being moved at a speed synchronous with vacuum imaging drum 300 rotation and proportional to the width of a writing swath, in which a plurality of aligned laser diodes are capable of being energized simultaneously. The pattern that optical printhead 500 transfers to the thermal print media 32 along vacuum imaging drum 300, is a helix.

Figure 3:
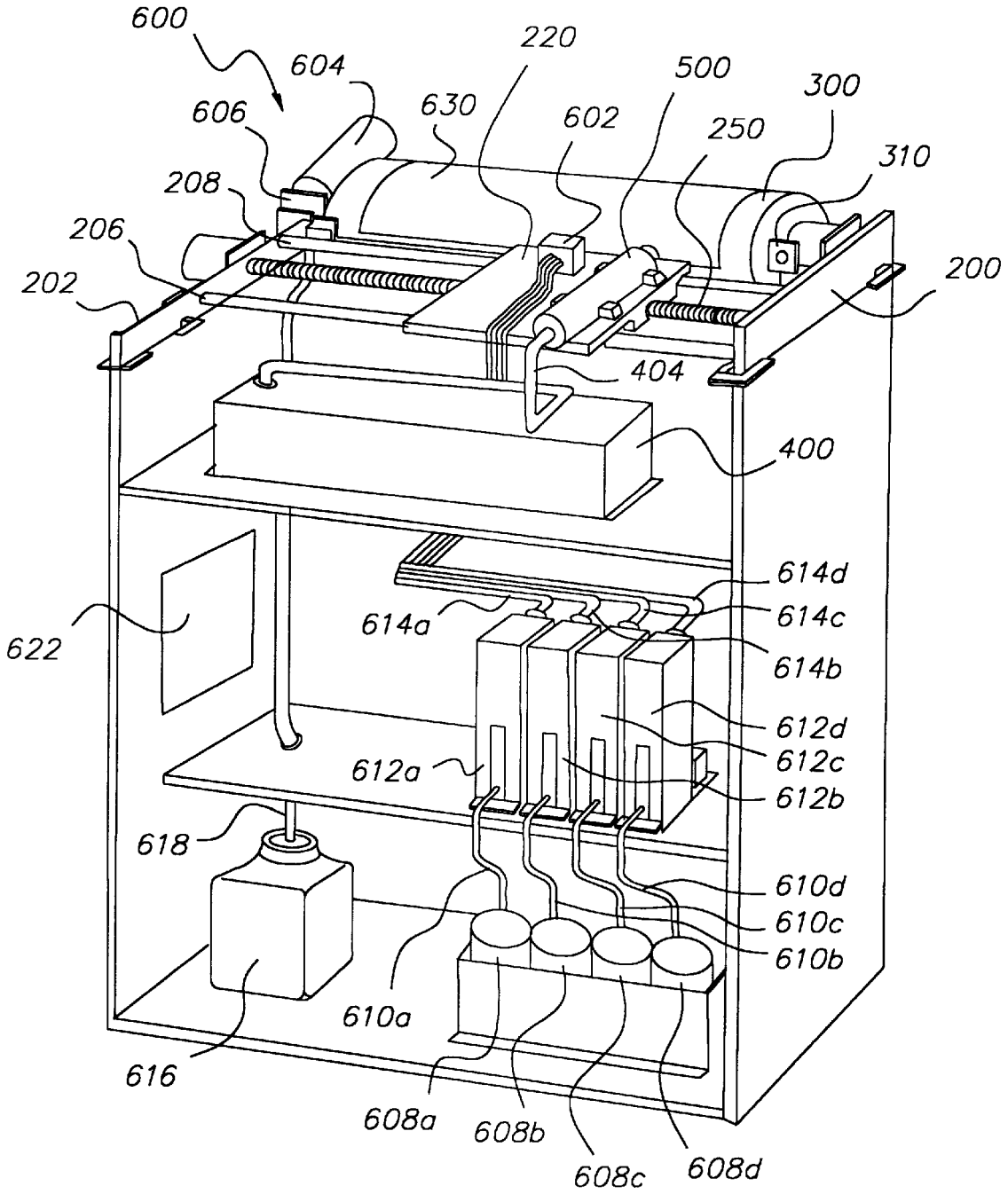
FIG. 3 shows a perspective view of an apparatus according to the present invention showing key components of a combined laser thermal and inkjet printer with covers removed for visibility.

FIG. 3 shows a combined laser thermal and inkjet printer according to the present invention, generally numbered 600, that employs both optical printhead 500 and an inkjet printhead 602. For clarity, FIG. 3 shows a perspective view, with cover removed, of key components. (Numerous support components, familiar to those working in the printer art, are not shown to allow visibility of components and structures for the present invention. Specifically, media handling components are not shown, but are described subsequently.)

Similar structures to those described above for the laser thermal color printer 10 are used for combined laser thermal and inkjet printer 600. That is, lathe bed scanning subsystem 200 includes lathe bed scanning frame 202 that supports front translation bearing rod 208 and rear translation bearing rod 206, along with lead screw 250 for controlling movement of translation stage member 220. An imaging media sheet 630 is wrapped about vacuum imaging drum 300. As vacuum imaging drum 300 rotates, translation stage member 220 is moved in a direction parallel to the axis of vacuum imaging drum 300, writing the image in a continuous, helical pattern.

Translation stage member 220 provides a mount mechanism for both types of printhead. As was described above, optical printhead 500 provides the optical assembly for focusing laser energy from laser assembly 400, with laser signals routed to optical printhead 500 by means of fiber optic cables 404. Translation stage member 220 also supports inkjet printhead 602. Inks are supplied from ink reservoirs 608*a*–608*d*. Typically, these inks are the four CMYK process colors. A corresponding pump input tube 610*a*–610*d*, pump 612*a*–612*d*, and pump output tube 614*a*–614*d* routes each color ink to inkjet printhead 602, using established techniques known in the inkjet printer art.

Inkjet printhead 602 maintenance is provided at a cleaning station 606, shown on the left side of lathe bed scanning frame 202. A cleaning solution dispenser 604 provides the required cleaning solution for maintaining proper printhead performance. A waste bottle 616 collects spent cleaning fluid and waste ink, routed by means of waste tube 618. Optical printhead 500 calibration is provided by a calibration sensor 310, mounted on the right side of lathe bed scanning frame 202. In cooperation with a machine logic control processor 622 that controls low-level operation of laser thermal and inkjet printer 600 functions, calibration sensor 310 allows measurement and subsequent adjustment of the output power provided by laser assembly 400.

For printing, machine control logic processor 622 operates according to an appropriate program for the printhead selected. When instructed to print using optical printhead 500, machine control logic processor 622 controls the motion of translation stage assembly 220 as described for the prior art system shown in FIG. 1. When instructed to print using inkjet printhead 602, machine control logic processor 622 controls the motion of translation stage assembly 220 in a similar fashion, making the necessary timing adjustments for different swath width, vacuum imaging drum 300 speed, and writing pattern that applies for inkjet printhead 602.

Figure 4:
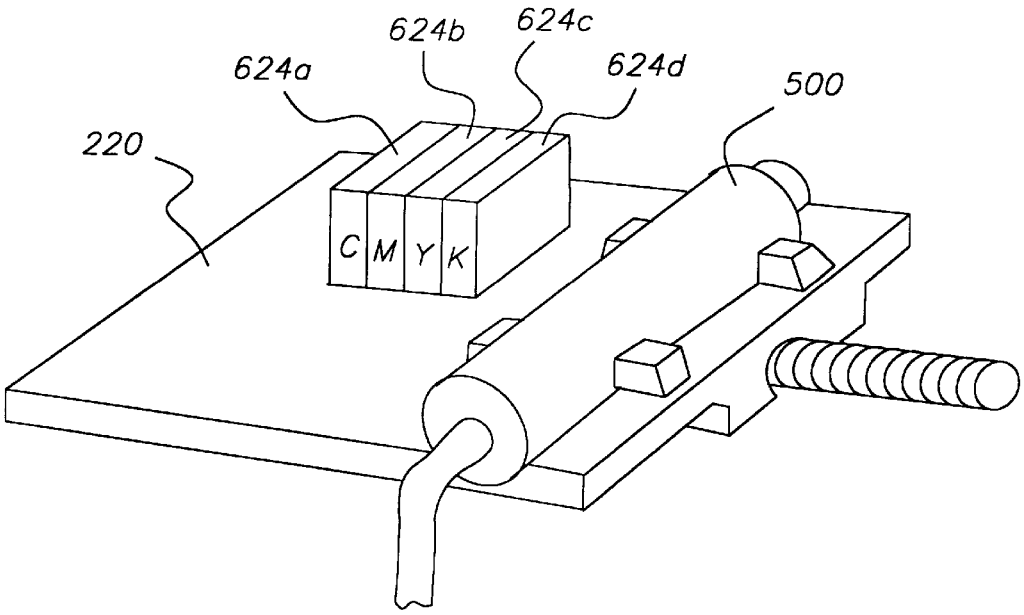
FIG. 4 shows an alternate arrangement of printhead components using ink cartridges combined with a laser thermal printer.

FIG. 3 shows the preferred embodiment, where inkjet components use continuous-flow technology. An alternate arrangement for inkjet printhead 602 using drop-on-demand (impulse) technology is shown in FIG. 4. Here, an ink cartridge 624*a*–624*d* is used for each color, typically CMYK, as shown. This arrangement provides a less costly method for producing inkjet prints using the same scanning subsystem.

The present invention allows a number of options for media handling, depending on the output desired from combined laser thermal and inkjet printer 600. The preferred embodiment employs the apparatus described in FIG. 1 above for imaging using optical printhead 500, with lower sheet material tray 50*a* supplying thermal print media 32. For imaging using inkjet printhead 602, alternate upper sheet material tray 50*b* holds inkjet receiver media 620. A similar sequence of operation for loading inkjet receiver media 620 applies as is described above for loading thermal print media 32. The sequence needed to load donor sheet material 36 is not used, since inkjet printhead 602 images directly onto the receiver.

One option available using the present invention is to use laser thermal and inkjet printer 600 to provide an inkjet print, such as might be used during early prepress stages of color proofing. Later, the same laser thermal and inkjet printer 600 is used during final stages of color proofing to provide a laser thermal print. This gives the benefit of a single printer that provides a customer with the quality of output print needed at a specific stage in the prepress color proofing process.

In an alternate embodiment, a laser thermal printhead and inkjet printhead are used for imaging onto the same print. As an example, laser thermal and inkjet printer 600 would be instructed to image onto thermal print media 32 using laser thermal printing, using the printing sequence described for color printer 10 above. But, instead of ejecting the imaged thermal print media 32 from vacuum imaging drum 300 after applying the last dye donor color, laser thermal and inkjet printer 600 would complete the print by imaging using one or more inks applied by means of inkjet printhead 602 after the sheet of dye donor material has been removed These inks applied could be, for example, specialty color inks applying colors not available in dye donor material 26. In this way, a sheet of thermal print media 32 output from laser thermal and inkjet printer 600 would have colors applied using both laser thermal and inkjet technologies.

In operation, a laser thermal and inkjet printer would operate in the following fashion. A first receiver is mounted on the vacuum imaging drum and the vacuum imaging drum is rotated. An inkjet image is printed on the first receiver, usually at low resolution, to produce a color proof. The low resolution color image is removed from the vacuum imaging drum and a second receiver is mounted on the vacuum imaging drum. A sheet of dye donor material is mounted in registration with the second receiver and the vacuum imaging drum is rotated. The laser printhead prints a second image, typically at a higher resolution, on the second receiver to produce a color proof that more closely approximates the output from a four plate printing press.

Figure 5:
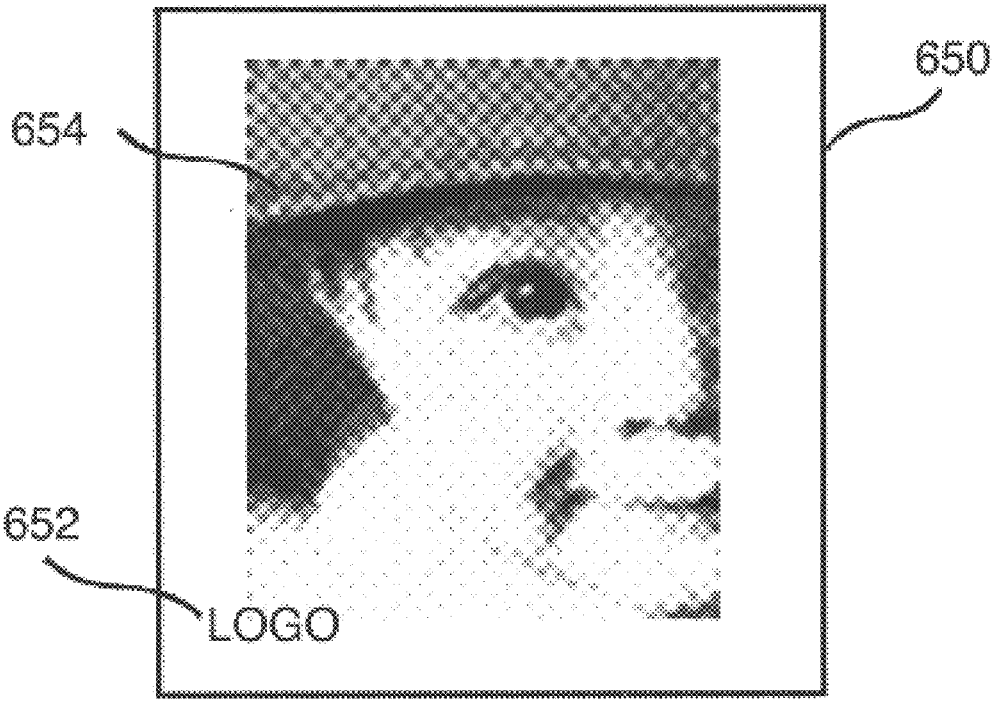
FIG. 5 shows an output print having a representation of a color halftone image printed using a laser thermal printhead and an ink image printed using an inkjet printhead.

Referring to FIG. 5 there is shown an output print 650 having a halftone image 654 printed using optical printhead 500 and also having a corporate logo 652 printed using inkjet printhead 602. Corporate logo 652 is printed using a specialty color ink, such as an ink formulated to print PANTONE Color 812 C, for example.

While the invention has been described with particular reference to its preferred embodiments, it will be understood by those skilled in the art that various changes may be made and equivalents may be substituted for elements in the preferred embodiments without departing from the scope of the invention. For example, while the preferred embodiment uses a vacuum imaging drum, alternative support structure for the receiver medium could be used, such as a flat platen. The inkjet printhead itself could be configured to use a single color or to use multiple color inks, as needed for the color print. The print pattern used by the inkjet printhead could be modified to use other than a helical pattern such as is employed for the laser thermal printhead. For example, the print sequence could use a "index-stop-print" sequence in which the printhead is advanced (indexed) to a linear position and stopped there, printing in place as the drum is rotated. Or, the inkjet printhead could be advanced to print in horizontal bands, with the imaging drum successively indexed to a position and stopped there until the horizontal band is completely printed. Therefore, what is provided is a printer having both inkjet and laser thermal printheads and an output print having both inkjet and laser thermal images.

The invention has been described in detail with particular reference to certain preferred embodiments thereof, but it will be understood that variations and modifications can be effected within the scope of the invention.

| PARTS LIST | |
|---|---|
| 10. | Color printer |
| 12. | Housing |
| 14. | Door |
| 16. | Ejection chute |
| 18. | Waste bin |
| 20. | Media stop |
| 24. | Media spool |
| 26. | Dye donor material |
| 32. | Thermal print media |
| 36. | Donor sheet material |
| 50a. | Lower sheet material tray |
| 50b. | Upper sheet material tray |
| 52a. | Lower media lift cam |

-continued

| PARTS LIST | |
|---|---|
| 52b. | Upper media lift cam |
| 54a. | Lower media roller |
| 54b. | Upper media roller |
| 56. | Media guide |
| 58. | Media guide rollers |
| 60. | Media staging tray |
| 80. | Transport mechanism |
| 100. | Media carousel |
| 110. | Media drive mechanism |
| 112. | Media drive rollers |
| 120. | Media knife assembly |
| 122. | Media knife blades |
| 180. | Color binding assembly |
| 182. | Media entrance door |
| 184. | Media exit door |
| 200. | Lathe bed scanning subsystem |
| 202. | Lathe bed scanning frame |
| 204. | Entrance passageway |
| 206. | Rear translation bearing rod |
| 208. | Front translation bearing rod |
| 220. | Translation stage member |
| 250. | Lead screw |
| 254. | Lead screw drive nut |
| 300. | Vacuum imaging drum |
| 310. | Calibration sensor |
| 400. | Laser assembly |
| 402. | Laser diode |
| 404. | Fiber optic cables |
| 406. | Distribution block |
| 500. | Optical printhead |
| 600. | Laser thermal and inkjet printer |
| 602. | Inkjet printhead |
| 604. | Cleaning solution dispenser |
| 606. | Cleaning station |
| 608a. | Ink reservoirs |
| 608b. | Ink reservoirs |
| 608c. | Ink reservoirs |
| 608d. | Ink reservoirs |
| 610a. | Pump input tube |
| 610b. | Pump input tube |
| 610c. | Pump input tube |
| 610d. | Pump input tube |
| 612a. | Pump |
| 612b. | Pump |
| 612c. | Pump |
| 612d. | Pump |
| 614a. | Pump output tube |
| 614b. | Pump output tube |
| 614c. | Pump output tube |
| 614d. | Pump output tube |
| 616. | Waste bottle |
| 618. | Waste tube |
| 620. | Inkjet receiver media |
| 622. | Machine logic control processor |
| 624a. | Ink cartridge |
| 624b. | Ink cartridge |
| 624c. | Ink cartridge |
| 624d. | Ink cartridge |
| 630. | Imaging media sheet |
| 650. | Output print |
| 652. | Corporate logo |
| 654. | Halftone image |

What is claimed is:

1. A color printer for printing color images comprising:

a vacuum imaging drum for supporting a first receiver and a dye donor of material in registration with said first receiver;

a motor which rotates said vacuum imaging drum;

an optical printhead for directing exposure energy onto said dye donor material, thereby transferring colorant from said dye donor material to said first receiver as said optical printhead is transported parallel to a surface of said vacuum imaging drum to create a first color image;

an inkjet printhead which applies ink directly to a second receiver mounted on said vacuum imaging drum as said inkjet printhead is transported parallel to said surface of said vacuum imaging drum to create a second color image.

2. The color printer of claim 1 wherein said dye donor material and said first receiver are removed from said vacuum imaging drum prior to mounting said second receiver on said vacuum imaging drum.

3. The color printer of claim 1 wherein said optical printhead is a laser printhead.

4. The color printer of claim 1 wherein said inkjet printhead uses continuous-flow ink delivery.

5. The color printer of claim 1 wherein said inkjet printhead uses drop-on-demand ink delivery.

6. The color printer of claim 1 wherein said optical printhead and said inkjet printhead are mounted on a common translation stage.

7. The color printer of claim 1 wherein said optical printhead and said inkjet printhead use a common machine control logic processor.

8. The color printer of claim 1 wherein said first receiver is paper.

9. The color printer of claim 1 wherein said first color image has a higher resolution than said second color image.

10. A printhead translation assembly for a color printer for applying colorant onto receivers, whereby images are printed on said receiver, said printhead translation assembly comprising:

a common translation stage which moves parallel to a surface of a first receiver;

an optical printhead attached to said common translation stage which directs energy onto a dye donor material in registration with said first receiver and applies donor colorant to said first receiver;

an inkjet printhead, attached to said common translation stage, which applies ink to a second receiver.

11. The printhead translation assembly of claim 10 wherein said optical printhead is a laser printhead.

12. The printhead translation assembly of claim 10 wherein said inkjet printhead is a continuous-flow inkjet printhead.

13. The printhead translation assembly of claim 10 wherein said inkjet printhead is a drop-on-demand inkjet printhead.

14. The printhead translation assembly of claim 10 wherein said common translation stage is moved by a lead screw.

15. A method for printing color images comprising the steps of:

mounting a first receiver on a vacuum imaging drum;

rotating said vacuum imaging drum;

moving an inkjet printhead parallel to a surface of said vacuum imaging drum while printing a low resolution color image;

removing said first receiver from said vacuum imaging drum;

mounting a second receiver on said vacuum imaging drum;

mounting a first sheet of dye donor material in registration with said second receiver; and moving a laser printhead parallel to said surface of said vacuum imaging drum while printing a first high resolution color image on said second receiver.

16. A method for printing color images as in claim 15 comprising the additional steps of:

removing said first sheet of dye donor material from said vacuum imaging drum;

mounting a second dye donor sheet on said vacuum imaging drum in registration with said second receiver;

moving said laser printhead parallel to said surface of said vacuum imaging drum while printing a second high resolution color image to said second receiver.

17. A method for printing color images as in claim 15 wherein said first receiver is paper.

18. A method for printing color images as in claim 15 wherein said second receiver is a film used for transferring images to paper.

19. A method for printing color images as in claim 15 wherein said inkjet printhead applies ink using continuous-flow printing.

20. A method for printing color images as in claim 15 wherein said inkjet printhead applies ink using drop-on-demand printing.

21. A method for printing color images as in claim 15 wherein said inkjet printhead and said laser printhead are mounted on a common translation stage.

22. A method for printing color images as in claim 15 wherein said laser printhead and said inkjet printhead use a common machine control logic processor.

23. A method for printing color images comprising the steps of:

mounting a receiver on a vacuum imaging drum;

rotating said vacuum imaging drum;

moving an inkjet printhead parallel to a surface of said vacuum imaging drum while printing a low resolution color image;

mounting a first sheet of dye donor material in registration with said receiver; and moving a laser printhead parallel to said surface of said vacuum imaging drum while printing a first high resolution color image on said receiver.

24. A method for printing color images as in claim 23 comprising the additional steps of:

removing said first sheet of dye donor material from said vacuum imaging drum;

mounting a second sheet of dye donor material on said vacuum imaging drum in registration with said receiver;

moving said laser printhead parallel to said surface of said vacuum imaging drum while printing a second high resolution color image to said receiver.

* * * * *